US007034461B2

(12) United States Patent
Brock

(10) Patent No.: US 7,034,461 B2
(45) Date of Patent: Apr. 25, 2006

(54) CERAMIC ARC TUBE WITH INTERNAL RIDGE

(75) Inventor: Lori R. Brock, Gloucester, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/246,953

(22) Filed: Sep. 19, 2002

(65) Prior Publication Data

US 2004/0056599 A1 Mar. 25, 2004

(51) Int. Cl.
*H01J 17/16* (2006.01)
*H01J 17/02* (2006.01)

(52) U.S. Cl. ..... 313/634; 313/609; 313/610

(58) Field of Classification Search ..... 313/634, 313/318.01, 318.05, 609, 610
See application file for complete search history.

(56) References Cited

U.S. PATENT DOCUMENTS

| | | | | |
|---|---|---|---|---|
| 1,933,329 | A * | 10/1933 | Hull | 313/566 |
| 2,116,429 | A * | 5/1938 | Gooskens | 313/611 |
| 5,866,982 | A * | 2/1999 | Scott et al. | 313/634 |
| 5,936,351 | A | 8/1999 | Lang | 313/634 |
| 6,583,563 | B1 * | 6/2003 | Venkataramani et al. | 313/634 |
| 6,646,380 | B1 * | 11/2003 | Kubon et al. | 313/631 |

* cited by examiner

*Primary Examiner*—Joseph Williams
*Assistant Examiner*—Matt Hodges
(74) *Attorney, Agent, or Firm*—Robert F. Clark

(57) ABSTRACT

A ceramic arc tube for a metal halide discharge lamp is described wherein the lower end well of the arc tube has an internal barrier ridge which substantially prevents migration of the metal halide condensate into the central region of the discharge chamber during vertical operation. The use of the ridge reduces fluctuation in the color temperature of vertically operated lamps and improves efficacy.

18 Claims, 3 Drawing Sheets

CERAMIC ARC TUBE WITH INTERNAL RIDGE

TECHNICAL FIELD

This invention is related to arc tubes for high intensity discharge lamps. More particularly, this invention is related to metal halide discharge lamps having bulgy-shaped ceramic arc tubes.

BACKGROUND OF THE INVENTION

High intensity discharge (HID) lamps containing metal halide salts are widely used for lighting applications. For many years, the arc tubes used to contain the discharge were made of quartz. More recently, lighting manufacturers have introduced ceramic arc tubes for metal halide HID lamps. The arc tubes are made of polycrystalline alumina and are capable of operating at higher temperatures than quartz. Lamps with ceramic arc tubes exhibit reduced color shift over the life of the lamp, have improved efficacy and lumen maintenance, and have higher CRI values than similar lamps made with quartz arc tubes.

Initially, the ceramic arc tubes of commercial metal halide lamps had the shape of a right circular cylinder. These arc tubes typically were constructed of three to five separate pre-sintered ceramic parts such as described in U.S. Pat. No. 5,424,609. The parts were joined by interference fits in multiple sintering steps.

A more sophisticated arc tube design has been recently introduced which uses a two-piece arc tube construction. Such a construction is illustrated in cross-section in FIG. 1 and described in co-pending U.S. patent application Ser. No. 10/077,504, filed Feb. 15, 2000, now U.S. Pat. No. 6,620,272 which is incorporated herein by reference. This design represents a significant improvement over the prior three- and five-part constructions. Unlike the right-cylinder shapes of the prior constructions, this design has curved walls 19 in the end wells 17*a*, 17*b* and is commonly referred to as a bulgy shape. The bulgy shape provides a more uniform temperature distribution and a reduced hot spot temperature compared to right-cylinder shapes.

According to the method described in co-pending U.S. patent application Ser. No. 10/077,504, the arc tube is made by joining two molded ceramic halves in their green state. Heat is applied to the surfaces to be joined to cause a localized melting of the binder. The surfaces are then brought together and joined by alternately applying compression and stretching. As illustrated in FIG. 1, this method leaves a cosmetic seam 5 in the center of the arc tube where the two halves were mated.

The discharge chamber 12 of the arc tube contains metal halides salts, mercury, and a buffer gas. When the lamp is in operation, the metal halide salts form a molten condensate. The position of the metal halide salt condensate in the arc tube influences the spectral characteristics of the lamp. For vertically-operated arc tubes, the metal halide condensate resides generally in a pool 7 in the lower end well 17*a*. However, for reasons which are not completely understood, droplets 8 of the metal halide condensate will migrate up the inner wall of the arc tube to near the seam 5 in the center of the discharge chamber 12.

The migration of the condensate during lamp operation leads to an undesirable fluctuation in the color temperature of the lamps. This is because the color temperature of the emission from the arc discharge is higher when the condensate is located in the end well than when it is located in the center region of the arc tube. For example, the color temperature of a lamp containing a fill chemistry designed to operate at 4200K (10 wt. % NaI, 12 wt. % TlI, 33 wt. % $CaI_2$, 15 wt. % $DyI_3$, 15 wt. % $HoI_3$, 15 wt. % $TmI_3$) ranges from 4100 to 4400K when the condensate is located in the end well and from 3800 to 4000K when the condensate is located in within the central region of the discharge chamber. Therefore, in order to maintain a consistent color temperature, it is important to control the position of the condensate with the arc tube.

SUMMARY OF THE INVENTION

It is an object of the invention to obviate the disadvantages of the prior art.

It is another object of the invention to provide a means for controlling the position of the metal halide condensate in a bulgy-shaped ceramic arc tube.

In accordance with one object of the invention, there is provided a ceramic arc tube comprising an axially symmetric body having opposed electrode-receiving members extending outwardly from the body along the symmetry axis, the body enclosing a discharge chamber having a lower end well, the lower end well having a curved wall and a circumferential ridge protruding from the curved wall into the discharge chamber.

In accordance with another object of the invention, there is provided a metal halide discharge lamp comprising a sealed outer envelope containing a ceramic arc tube, the ceramic arc tube having a body enclosing a discharge chamber, the body having a lower end well and opposed electrode-receiving members extending outwardly from the body, each electrode-receiving member having an electrode assembly passing therethrough and being sealed to the electrode-receiving member, the electrode assemblies being connectable to an external source of electrical power, the discharge chamber containing a metal halide fill, the lower end well having a curved wall and a circumferential ridge protruding from the curved wall into the discharge chamber.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

The ceramic arc tube of this invention achieves control over the position of the metal halide condensate by interposing an internal barrier ridge in at least the lower end well of the arc tube. The internal ridge is located on the curved wall of the end well and keeps the condensate substantially in the lower end well. The effectiveness of the ridge can be observed visually since the condensate forms a dark ring in the lower end well in the region just below the ridge. Lamps made with internally ridged arc tubes exhibit less lamp-to-lamp variation in color temperature and a higher efficacy (lumens per watt (LPW)).

Figure 2:
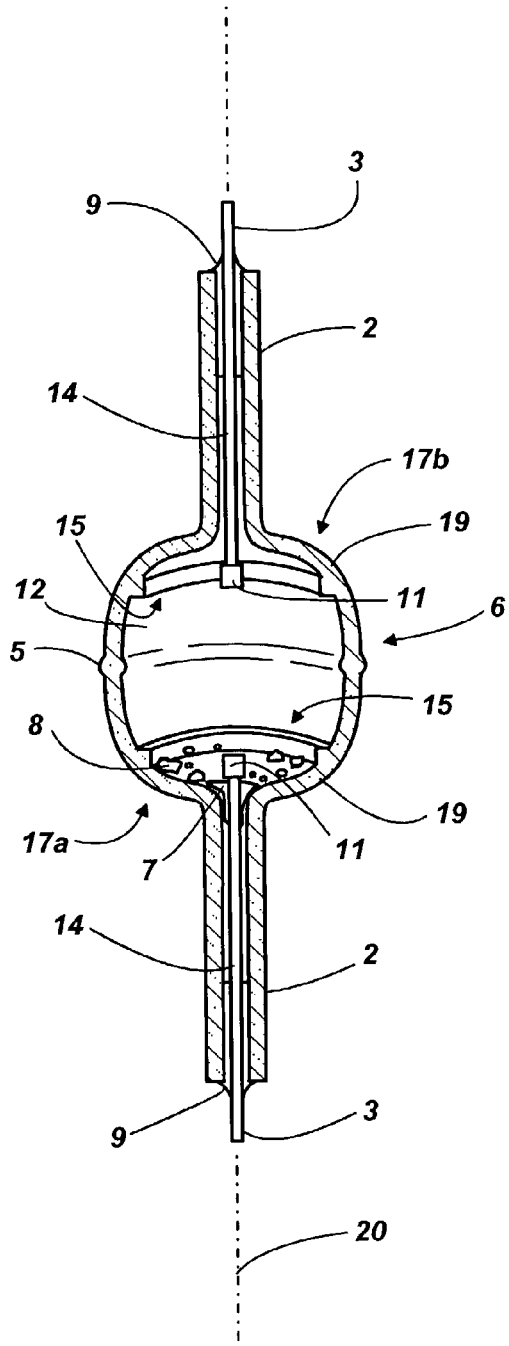
FIG. 2 is a cross-sectional illustration of a preferred embodiment of the internally ridged arc tube of this invention.

FIG. 2 is a cross-sectional illustration of the internally ridged arc tube of this invention. The arc tube is shown for vertical operation in either a base-up or base-down lamp orientation. The arc tube is composed of a translucent or transparent ceramic material, typically polycrystalline alumina. The bulgy-shaped arc tube has an axially symmetric body 6 which encloses a discharge chamber 12. Two opposed electrode-receiving members 2 extend outwardly from the body 6 along the symmetry axis 20. As shown here, it is preferred that the electrode-receiving members be comprised of capillary tubes which have been integrally molded with the arc tube body.

Electrode assemblies 14 are inserted into each electrode-receiving member 2. The distal ends 3 of the electrode assemblies 14 protrude out of the arc tube to provide an electrical connection. The electrode assemblies are sealed hermetically to the electrode-receiving members by a frit material 9 (preferably, a $Al_2O_3$—$SiO_2$—$Dy_2O_3$ frit) and pass through the electrode-receiving members to proximal ends 11 which protrude into the discharge chamber 12. The proximal ends of the electrode assemblies may be fitted with a tungsten coil or other similar means for providing a point of attachment for the arc discharge. During lamp operation, the electrode assemblies act to conduct an electrical current from an external source of electrical power (not shown) to the interior of the arc tube thereby permitting an arc discharge to be formed in the discharge chamber.

Figure 1:
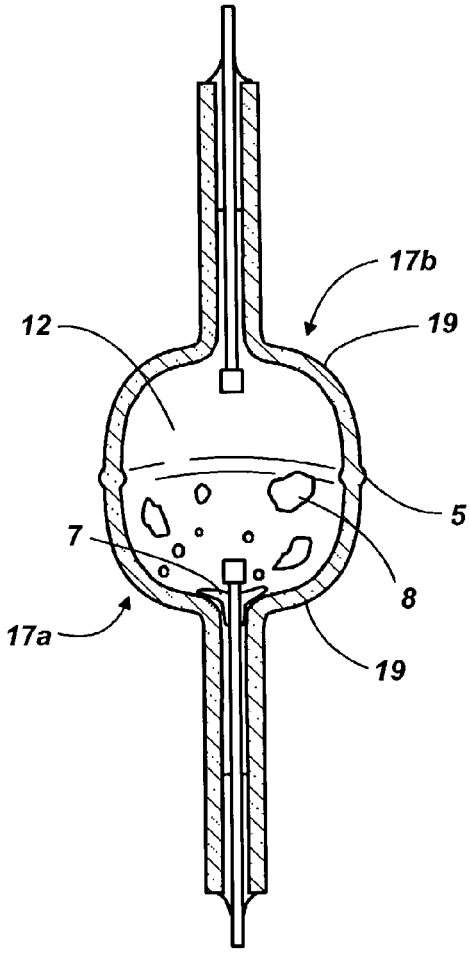
Fig. 1 (Prior Art)
FIG. 1 is a cross-sectional illustration of the condensate migration problem observed in a prior art bulgy-shaped arc tube.

The discharge chamber contains a fill material typically comprised of metal halide salts and mercury. The composition of the fill can be varied to produce different emission characteristics. Typical metal halide fills include the iodides of Na, Ca, Tl, Tm, Ho and Dy. For example, a fill designed to have a color temperature of 3000K contains 51 wt. % NaI, 14 wt. % TlI, 14 wt. % $CaI_2$, 7 wt. % $DyI_3$, 7 wt. % $HoI_3$, and 7 wt. % $TmI_3$ whereas a more preferred fill designed to have a color temperature of 4200K contains 10 wt. % NaI, 12 wt. % TlI, 33 wt. % $CaI_2$, 15 wt. % $DyI_3$, 15 wt. % $HoI_3$, 15 wt. % $TmI_3$. The discharge chamber further contains a buffer gas which is typically argon at a pressure of 30 to 300 torr. As described previously, the metal halide fill forms a molten condensate during lamp operation. In a vertically operated arc tube, the condensate tends to collect in a pool 7 around the point where the proximal end 11 of the electrode assembly 14 enters the lower end well 17*a*. With some types of metal halide fills, droplets 8 of molten condensate tend to migrate up the inner wall of the arc tube and into the central region of the discharge chamber near the seam 5. The migration of the condensate droplets 8 up the inner wall is illustrated in FIG. 1.

Referring again to FIG. 2, the arc tube of this invention hinders the migration of the condensate by interposing a internal barrier ridge 15 in the lower end well 17*a*. During operation of the arc tube, the internal ridge 15 substantially constrains the condensate to the region below the internal ridge. In the embodiment shown in FIG. 2, the internal barrier ridge 15 is a circumferential ridge which protrudes into the discharge chamber 12 from the curved wall 19 of the lower end well 17*a*. Although it is only necessary to include a ridge in the lower end well where the condensate collects, it is preferred that both end wells 17*a*, 17*b* of the arc tube contain internal ridges 15 as shown in FIG. 2. This preferred embodiment allows the lamp to be operated in either a base-up or a base-down orientation thereby increasing the versatility of the lamp. In addition, the arc tube manufacturing is simplified because only one molded part needs to be produced because both halves of the arc tube are identical.

Figure 3:
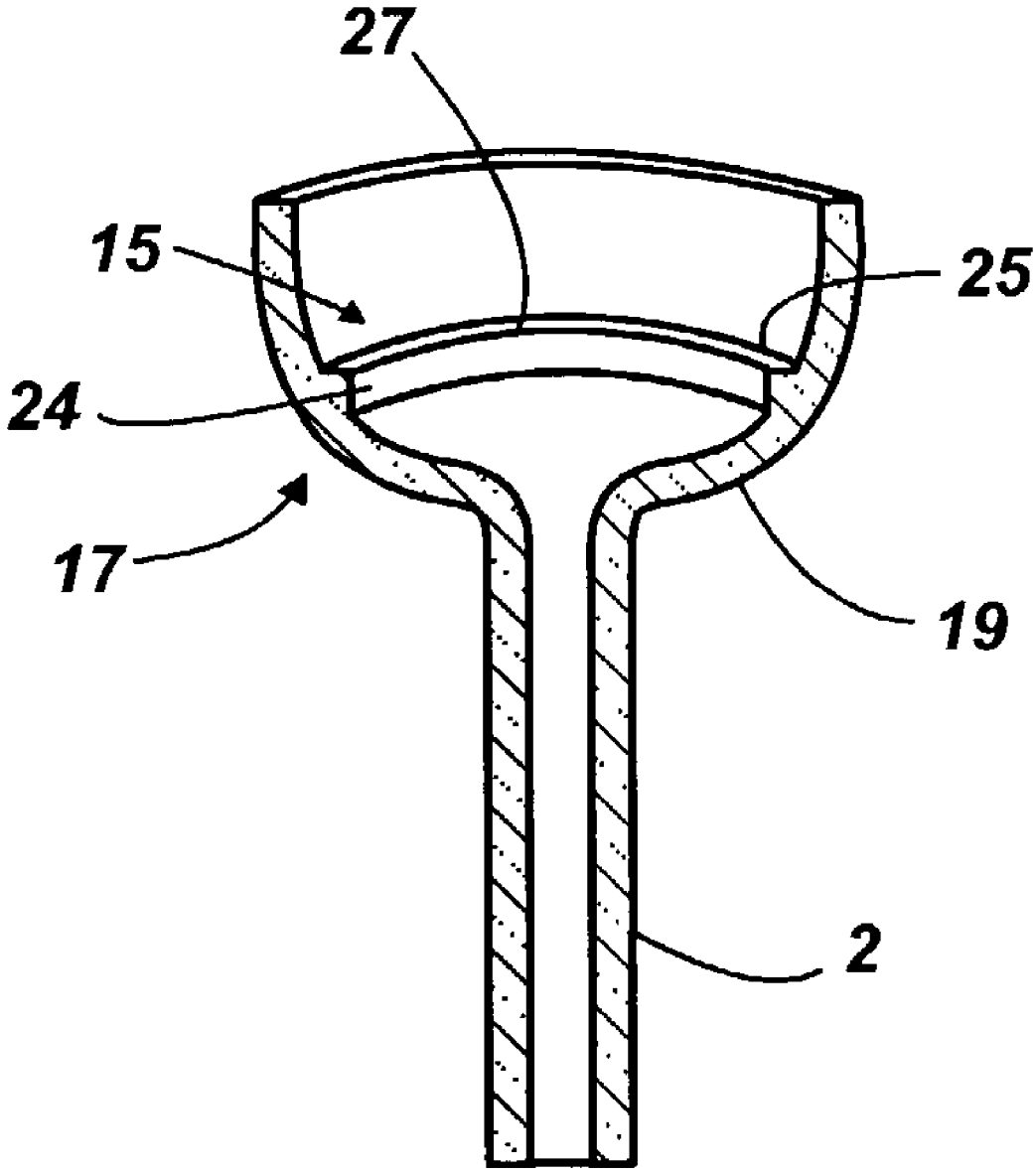
FIG. 3 is a cross-sectional illustration of a molded arc tube half prior to assembling the internally-ridged arc tube of this invention.

FIG. 3 is a cross-sectional illustration of one of the molded halves used to make the arc tube. In a preferred embodiment, the circumferential ridge 15 is comprised of two orthogonal faces 24 and 25. One of the faces 24 is parallel to the symmetry axis of the arc tube and the other face 25 is perpendicular to the axis. The two orthogonal faces intersect to form the edge 27 of the ridge 15. A preferred method of joining the two molded halves is described in co-pending U.S. patent application Ser. No. 10/077,504.

Figure 4:
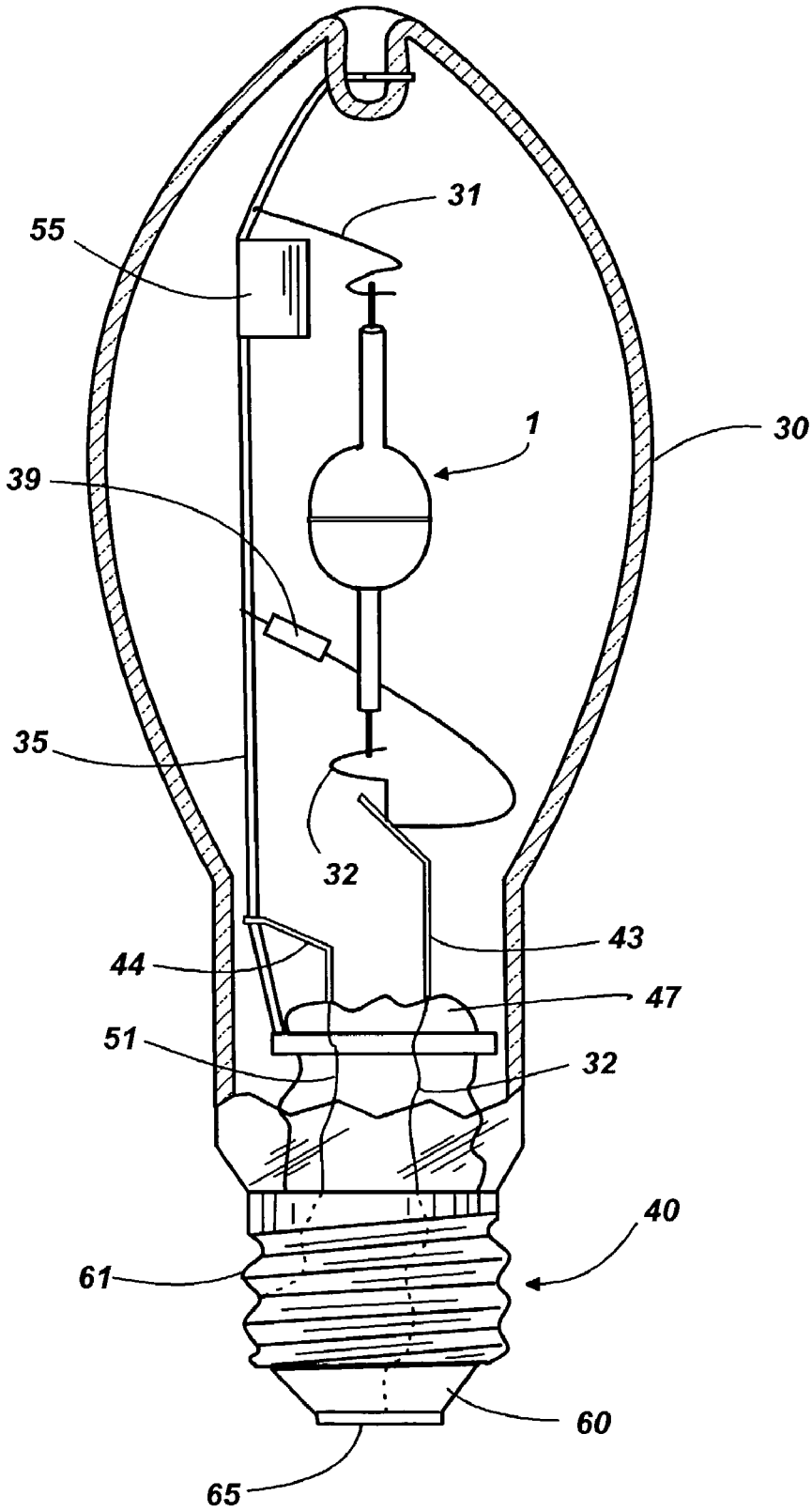
FIG. 4 is a partially broken-away illustration of a metal halide lamp containing the internally ridged arc tube of this invention.

FIG. 4 is an partially broken-away illustration of a metal halide lamp containing the internally ridged arc tube 1. The lamp is shown in a base-down orientation. The arc tube 1 is connected at one end to lead 31 which is attached to frame 35 and at the other end to lead 32 which is attached to mounting post 43. Electrical power is supplied to the lamp through screw base 40. The threaded portion 61 of screw base 40 is electrically connected to frame 35 through leadwire 51 which is connected to a second mounting post 44. Base contact 65 of screw base 40 is electrically isolated from the threaded portion 61 by insulator 60. Leadwire 32 provides an electrical connection between the base contact 65 and the mounting post 43. A UV-generating starting aid 39 is connected between mounting post 43 and frame 35. Leadwires 51 and 32 pass through and are sealed within the glass stem 47. A glass outer envelope 30 surrounds the arc tube and its associated components and is sealed to stem 47 to provide a gas-tight environment. Typically, the outer envelope is evacuated, although in some cases it may contain up to 400 torr of nitrogen gas. A getter strip 55 is used to reduce contamination of the envelope environment.

EXAMPLES

A series of 20 metal halide discharge lamps with bulgy-shaped 70 watt arc tubes were fabricated. The arc tubes contained 260 torr of argon and a 4200K metal halide fill comprised of 4.0 mg Hg, 0.725 mg NaI, 2.393 mg $CaI_2$, 0.870 mg TlI, 1.088 mg $DyI_3$, 1.088 mg $HoI_3$, and 1.088 mg $TmI_3$. The lamps were divided into four groups:

Group 1: Internally ridged arc tubes plus 0.5 mg frit and NDL fill.

Group 2: Standard arc tubes plus 0.5 mg frit and NDL fill.

Group 3: Internally ridged arc tubes plus standard NDL fill.

Group 4: Standard arc tubes plus standard NDL fill.

Each group contained five lamps. The small amount of frit material ($Al_2O_3$—$SiO_2$—$Dy_2O_3$) added to Groups 1 and 2 is known to exacerbate the condensate migration problem in these lamps. This makes it useful in performing accelerated aging tests.

The lamps were operated vertically, base-up for 100 hours on 70 W electronic ballasts. Photometric data was recorded and is given in Table 1. Average values and the standard deviation are provided for each measurement. For group 4, only data for four lamps is presented as one lamp would not ignite.

TABLE 1

| Group | | Lamp Voltage (V) | Lamp Current (A) | Lumens | LPW | Chromaticity x | Chromaticity y | Color Temp. (K) |
|---|---|---|---|---|---|---|---|---|
| 1 | Ave. | 96.5 | 0.9259 | 5900 | 84.3 | 0.383 | 0.377 | 3934 |
| | Std. Dev. | 5.2 | 0.0358 | 128 | 1.8 | 0.005 | 0.008 | 105 |
| 2 | Ave. | 93.7 | 0.9517 | 5450 | 77.9 | 0.372 | 0.382 | 3955 |
| | Std. Dev. | 9.3 | 0.0603 | 777 | 11.1 | 0.005 | 0.005 | 145 |
| 3 | Ave. | 89.9 | 0.9533 | 6198 | 88.5 | 0.372 | 0.382 | 4263 |
| | Std. Dev. | 1.8 | 0.0126 | 196 | 2.8 | 0.002 | 0.003 | 32 |
| 4 | Ave. | 85.3 | 0.9993 | 5948 | 85.0 | 0.370 | 0.378 | 4340 |
| | Std. Dev. | 3.1 | 0.0268 | 178 | 2.5 | 0.004 | 0.007 | 52 |

The lamps with the arc tubes having the internal ridge in both the frit-containing and frit-free groups (Groups 1 and 3) exhibited a smaller spread in color temperature than the lamps having the standard arc tubes (Groups 2 and 4). The lamps with the internally ridged arc tubes also exhibited a higher average efficacy (LPW) than the standard lamps.

While there has been shown and described what are at the present considered the preferred embodiments of the invention, it will be obvious to those skilled in the art that various changes and modifications may be made therein without departing from the scope of the invention as defined by the appended claims.

I claim:

1. A ceramic arc tube for a discharge lamp comprising:

an axially symmetric ceramic body having first and second opposed electrode-receiving members extending outwardly from the body along the symmetry axis, the ceramic body enclosing a discharge chamber having a lower end well, the lower end well having a curved wall that curves continuously and outwardly from the first electrode receiving member to the center of the discharge chamber and a circumferential ridge protruding from the curved wall into the discharge chamber, the ridge having two orthogonal faces.

2. The arc tube of claim 1 wherein the arc tube further has an upper end well having a second curved wall that curves continuously and outwardly from the second electrode receiving member to the center of the discharge chamber and a second circumferential ridge protruding from the second curved wall into the discharge chamber, the second circumferential ridge having two orthogonal faces.

3. The arc tube of claim 1 wherein electrode-receiving members are capillary tubes.

4. The arc tube of claim 1 wherein one of the faces is parallel to the symmetry axis and one is perpendicular to the symmetry axis.

5. The arc tube of claim 2 wherein one of the faces of each ridge is parallel to the symmetry axis and the other is perpendicular to the symmetry axis.

6. The arc tube of claim 1 wherein the arc tube is comprised of polycrystalline alumina.

7. The arc tube of claim 2 wherein the arc tube is made from two identical molded halves.

8. A discharge lamp comprising an outer envelope, a lamp base, and a lamp stem, the outer envelope being sealed to the lamp stem and containing a ceramic arc tube, the lamp base having leadwires attached thereto and being connectable to an external source of electrical power, the leadwires passing through and being sealed to the lamp stem in order to supply electrical power to the arc tube from the external source; and the ceramic arc tube having an axially symmetric body enclosing a discharge chamber, the body having a lower end well and first and second opposed electrode-receiving members extending outwardly from the body along the symmetry axis, each electrode-receiving member having an electrode assembly passing therethrough and being sealed to the electrode-receiving member with a frit material, a proximal end of the electrode assemblies extending into the discharge chamber, a distal end of the electrode assemblies being connectable to the electrical power supplied by the leadwires, the discharge chamber containing a metal halide fill and a buffer gas, the lower end well having a curved wall that curves continuously and outwardly from the first electrode receiving member to the center of the discharge chamber and a circumferential ridge protruding from the curved wall into the discharge chamber, the ridge having two orthogonal faces.

9. The lamp of claim 8 wherein the arc tube also contains mercury.

10. The lamp of claim 8 wherein the outer envelope contains a vacuum.

11. The lamp of claim 9 wherein the metal halide fill comprises 10 wt. % NaI, 12 wt. % TlI, 33 wt. % $CaI_2$, 15 wt. % $DyI_3$, 15 wt. % $HoI_3$, 15 wt. % $TmI_3$.

12. The lamp of claim 8 wherein the arc tube further has an upper end well having a second curved wall that curves continuously and outwardly from the second electrode receiving member to the center of the discharge chamber and a second circumferential ridge protruding from the second curved wall into the discharge chamber, the second circumferential ridge having two orthogonal faces.

13. The lamp of claim 8 wherein a condensate of the metal halide fill is substantially located below the ridge in the lower end well during vertical operation of the lamp.

14. The lamp of claim 12 wherein a condensate of the metal halide fill is substantially located below the ridge in the lower end well during vertical operation of the lamp in either a base-up or base-down orientation.

15. The lamp of claim 9 wherein the buffer gas is argon.

16. A metal halide discharge lamp comprising a sealed outer envelope containing a ceramic arc tube, the ceramic arc tube having a body enclosing a discharge chamber, the body having a lower end well and opposed electrode-receiving members extending outwardly from the body, each electrode-receiving member having an electrode assembly passing therethrough and being sealed to the electrode-receiving member, the electrode assemblies being connectable to an external source of electrical power, the discharge chamber containing a metal halide fill, the lower end well having a curved wall that curves continuously and outwardly from the first electrode receiving member to the center of the discharge chamber and a circumferential ridge protruding from the curved wall into the discharge chamber, the ridge having two orthogonal faces.

17. The lamp of claim 16 wherein a condensate of the metal halide fill is substantially located below the ridge in the lower end well during lamp operation.

18. The lamp of claim 17 wherein metal halide fill comprises 10 wt. % NaI, 12 wt. % TlI, 33 wt. % $CaI_2$, 15 wt. % $DyI_3$, 15 wt. % $HoI_3$, 15 wt. % $TmI_3$ and the arc tube further contains mercury and a buffer gas.

* * * * *